US011309635B2

(12) United States Patent
Borrelli et al.

(10) Patent No.: US 11,309,635 B2
(45) Date of Patent: Apr. 19, 2022

(54) FRESNEL ZONE PLATE LENS DESIGNS FOR MICROWAVE APPLICATIONS

(71) Applicant: CORNING INCORPORATED, Corning, NY (US)

(72) Inventors: Nicholas Francis Borrelli, Elmira, NY (US); Wageesha Senaratne, Horseheads, NY (US); Aramais Robert Zakharian, Painted Post, NY (US)

(73) Assignee: Corning Incorporated, Corning, NY (US)

( * ) Notice: Subject to any disclaimer, the term of this patent is extended or adjusted under 35 U.S.C. 154(b) by 0 days.

(21) Appl. No.: 16/912,809

(22) Filed: Jun. 26, 2020

(65) Prior Publication Data

US 2020/0412009 A1 Dec. 31, 2020

Related U.S. Application Data

(60) Provisional application No. 62/867,481, filed on Jun. 27, 2019.

(51) Int. Cl.

| | |
|---|---|
| ***H01Q 15/02*** | (2006.01) |
| ***H01Q 19/06*** | (2006.01) |
| ***H01Q 21/06*** | (2006.01) |

(52) U.S. Cl.
CPC ..... *H01Q 19/065* (2013.01); *H01Q 21/065* (2013.01)

(58) Field of Classification Search
CPC .... H01Q 19/06; H01Q 19/062; H01Q 19/065; H01Q 25/008; H01Q 21/06;
(Continued)

(56) References Cited

U.S. PATENT DOCUMENTS 3,273,155 A * 9/1966 Raabe ..... H01Q 15/02 343/753
3,312,974 A * 4/1967 Lewis ..... H01Q 19/065 343/755

(Continued)

FOREIGN PATENT DOCUMENTS

| | | |
|---|---|---|
| DE | 19737254 C1 | 3/1999 |
| JP | 2002-171122 A | 6/2002 |
| WO | 2009/063384 A1 | 5/2009 |

OTHER PUBLICATIONS

Houten et al., "The Elliptical Fresnel-Zone Plate Antenna", Antennas and Prop. 4-7, Apr. 1995, pp. 97-101.

(Continued)

*Primary Examiner* — Tho G Phan
(74) *Attorney, Agent, or Firm* — Svetlana Z. Short

(57) ABSTRACT

An antenna unit including an antenna array having a plurality of antennas and a lens plate comprising a mask pattern. The antenna array defines a first plane, and the lens plate defines a second plane. The lens plate is spaced apart from the antenna array, and the second plane is parallel to the first plane. The mask pattern is configured to focus first waves incident on the lens plate through diffraction to a region of the antenna array. The first waves are incident on the lens plate at a first angle relative to an axis normal to the second plane. The mask pattern is configured to focus second waves incident on the lens plate through diffraction to the first region of the antenna array. The second waves are incident on the lens plate at a second angle relative to the axis that is different from the first angle.

20 Claims, 8 Drawing Sheets

(58) Field of Classification Search
CPC .. H01Q 21/065; H01Q 21/0031; H01Q 21/00; H01Q 15/02; H01Q 15/08; H01Q 25/00; H01Q 3/46; H01Q 3/446; H01Q 15/00
See application file for complete search history.

(56) References Cited

U.S. PATENT DOCUMENTS 5,071,207 A 12/1991 Ceglio et al.
5,360,973 A * 11/1994 Webb ..... G01R 1/071 250/370.01
6,624,934 B1 * 9/2003 Moshrefzadeh ..... G03B 21/625 359/457
6,720,936 B1 * 4/2004 Koolish ..... H01Q 3/01 343/909
7,253,781 B2 * 8/2007 Furuhi ..... H01Q 3/44 343/753
7,339,551 B2 * 3/2008 Peterson ..... H01Q 3/46 343/755
7,456,803 B1 * 11/2008 Sievenpiper ..... H01Q 15/02 343/700 MS
9,559,427 B2 1/2017 Darooka
10,116,051 B2 * 10/2018 Scarborough ..... H01Q 21/061
10,224,638 B2 3/2019 Mozharovskiy et al.
10,461,435 B2 * 10/2019 Moore ..... H01Q 19/065
2009/0218523 A1 * 9/2009 Kare ..... B82Y 20/00 250/505.1
2018/0191078 A1 7/2018 Moore

OTHER PUBLICATIONS

Hristov et al., "Indoor Signal Focusing by Means of Fresnel Zone Plate Lens Attached to Building Wall", IEEE Transactions on Antennas and Propagation, vol. 52, No. 4, Apr. 2004, pp. 933-940.
Extended European Search Report and Search Opinion; 20182092.5; dated Oct. 28, 2020; 12 pages; European Patent Office.
Markovich et al., "Bifocal Fresnel Lens Based on the Polarization-Sensitive Metasurface", IEEE Transactions on Antennas and Propagation, vol. 66, No. 5, May 2018, pp. 2650-2654.
Matos et al., "Design of a 40 dBi Planar Bifocal Lens for Mechanical Beam Steering at Ka-Band", 2016 10th European Conference on Antennas and Propagation (Eucap), European Association of Antennas and Propagation, Apr. 10, 2016, pp. 1-4.

* cited by examiner

FRESNEL ZONE PLATE LENS DESIGNS FOR MICROWAVE APPLICATIONS

CROSS-REFERENCE TO RELATED APPLICATIONS

This application claims the benefit of priority under 35 U.S.C. § 119 of U.S. Application No. 62/867,481 filed on Jun. 27, 2019 the contents of which are relied upon and incorporated herein by reference in their entirety as if fully set forth below.

BACKGROUND

The disclosure relates generally to an antenna unit and, in particular, to an antenna unit incorporating a variety of Fresnel zone plate lens designs utilizing patterned masks. Deployment of the 5G network has required the installation of many new antennas to send and receive 5G signals. Such antennas relay data throughout the network in a highly directional manner. Efficient sending and receiving of these 5G signals allows for the 5G network to be built out in an economical manner.

SUMMARY

In one aspect, embodiments of the disclosure relate to an antenna unit. The antenna unit includes an antenna array having a plurality of antennas and a lens plate comprising a mask pattern. The antenna array defines a first plane, and the lens plate defines a second plane. The lens plate is spaced apart from the antenna array, and the second plane of the lens plate is substantially parallel to the first plane of the antenna array. The mask pattern is configured to focus first waves incident on the lens plate through diffraction to a first region of the antenna array. The first waves are incident on the lens plate at a first angle relative to an axis normal to the second plane of the lens plate. The mask pattern is also configured to focus second waves incident on the lens plate through diffraction to the first region of the antenna array. The second waves are incident on the lens plate at a second angle relative to the axis in which the second angle is different from the first angle.

In another aspect, embodiments of the disclosure relate an antenna unit. The antenna unit includes an antenna array comprising a plurality of antennas and a lens plate comprising a mask pattern. The antenna array defines a first plane, and the lens plate defines a second plane. The lens plate is spaced apart from the antenna array, and the second plane of the lens plate is substantially parallel to the first plane of the antenna array. The mask pattern includes a Fresnel zone plate having a center ring centered on a first axis normal to the second plane of the lens plate. The mask pattern is configured to focus waves incident on the lens plate along a second axis normal to second plane of the lens plate to a region of the antenna array that is located on the first axis. The first axis is spaced apart from the second axis.

In still another aspect, embodiments of the disclosure relate to an antenna unit. The antenna unit includes an antenna array having a plurality of antennas and a lens plate comprising a mask pattern. The antenna array defines a first plane, and the lens plate defines a second plane. The lens plate is spaced apart from the antenna array, and the second plane of the lens plate is substantially parallel to the first plane of the antenna array. The mask pattern is configured to focus waves incident on the lens plate to at least two different focal points within the antenna array.

Additional features and advantages will be set forth in the detailed description that follows, and, in part, will be readily apparent to those skilled in the art from the description or recognized by practicing the embodiments as described in the written description and claims hereof, as well as the appended drawings.

It is to be understood that both the foregoing general description and the following detailed description are merely exemplary, and are intended to provide an overview or framework to understand the nature and character of the claims.

BRIEF DESCRIPTION OF THE DRAWINGS

The accompanying drawings are included to provide a further understanding and are incorporated in and constitute a part of this specification. The drawings illustrate one or more embodiment(s), and together with the description serve to explain principles and the operation of the various embodiments. In the drawings.

DETAILED DESCRIPTION

Embodiments of the present disclosure relate to an antenna unit having a Fresnel zone plate lens with a mask pattern that manipulates the focal point(s) and/or direction of an incident incoming wave. In embodiments, the mask pattern allows for waves having two different incident angles to have the same focal spot on an antenna array of the antenna unit. Further, in embodiments, the mask pattern allows for the focal spot to be offset vertically and/or horizontally from the center position. In still further embodiments, the mask pattern is created by superimposing multiple Fresnel zone plates to produce multiple focal points that can be spaced out vertically and/or horizontally.

The mask patterns disclosed herein include alternating opaque (absorbing or reflecting) and transparent sections or sections with alternating thicknesses whose spacings are dictated by the lens focal length at the specified microwave frequency. The mask patterns can be produced through various deposition or coating or printing techniques, such as screen printing, spray coating, slot coating, and thin film deposition techniques. Further, in embodiments, the mask patterns can be produced trough material removal or addition.

Applicant believes that the antenna units described herein are applicable to the 5G infrastructure. As used herein, "5G" refers to signals transmitted via microwaves, in particular having a frequency of 20 GHz to 100 GHz. The 5G network includes many antenna units that transmit directional waves to other antenna units. Applicants have found a way to enhance the lens gain of the antenna units by focusing the waves incident upon the antenna units to specific, desired regions of an antenna array. In this way, the antenna units can transmit and receive over greater distances, thereby reducing the required number of antenna units in the network. Various embodiments of an antenna unit, in particular that is usable in the 5G infrastructure, are disclosed herein. These embodiments are presented by way of example and not by way of limitation.

Figure 1:
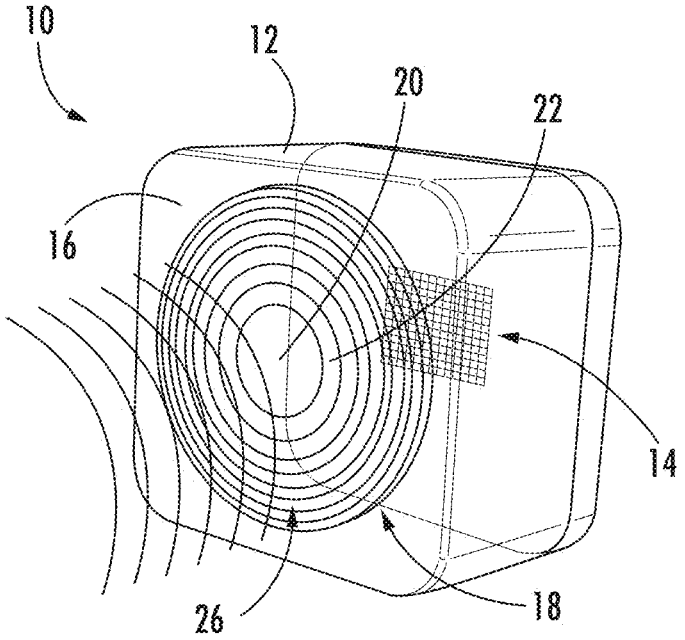
FIG. 1 depicts an antenna unit, according to an exemplary embodiment.

FIG. 1 depicts an embodiment of an antenna unit 10 having a housing 12 surrounding an antenna array 14. In embodiments, the antenna array 14 comprises a plurality of individual antennas, such as patch antennas, mounted to a ground plane. In embodiments, the patch antennas are rectangular sheets (i.e., "patches") of metal that may be connected with microstrip transmission lines so as to group the antennas into multiple phased arrays. The housing 12 includes a lens plate 16. In embodiments, the lens plate 16 is a planar surface arranged parallel to and spatially disposed from a plane defined by the antenna array 14. By "parallel" or "substantially parallel" it is meant that the plane of the lens plate 16 is substantially geometrically parallel to within about +/−15° to the plane of the antenna array, such as within about +/−10°, such as within about +/−5°, such as within about +/−2° or for more complex geometry (e.g., slightly convex curve, etc.), the net angle is within about +/−15°. As will be disclosed herein, the lens plate 16 focuses the intensity of electromagnetic waves incident upon the lens plate 16 onto a particular region of the antenna array 14.

In order to focus the radiation, the lens plate 14 includes a mask pattern 18 including a series of first sections 20 and second sections 22. As will be appreciated from the discussion that follows, the mask pattern 18 focuses the incident waves via diffraction from the first sections 20 and the second sections 22. In embodiments, the first sections 20 are opaque, and the second sections 22 are transparent. By "opaque," it is meant that the first sections 20 block electromagnetic radiation of a particular wavelength from passing through the lens in the area of the first sections 20. By "transparent," it is meant that the second sections 22 permit electromagnetic radiation of a particular wavelength to pass through the lens in the area of the second sections 22. In embodiments, the second sections 22 transmit at least 90% of electromagnetic radiation of a particular wavelength through the lens in the area of the second sections 22. In other embodiments, the second sections 22 transmit at least 95% of electromagnetic radiation of a particular wavelength through the lens in the area of the second sections 22, and in still other embodiments, the second sections 22 transmit at least 98% of electromagnetic radiation of a particular wavelength through the lens in the area of the second sections 22. In other embodiments, the first sections 20 have a different thickness than the second sections 22.

In particular embodiments, a difference in thickness of the lens plate 16 is provided between the first sections 20 and the second sections 22. In embodiments, a difference in thickness between the first sections 20 and the second sections 22 is chose to result in a path length difference equivalent to the wavelength of the incident wave divided by two.

Figure 2:
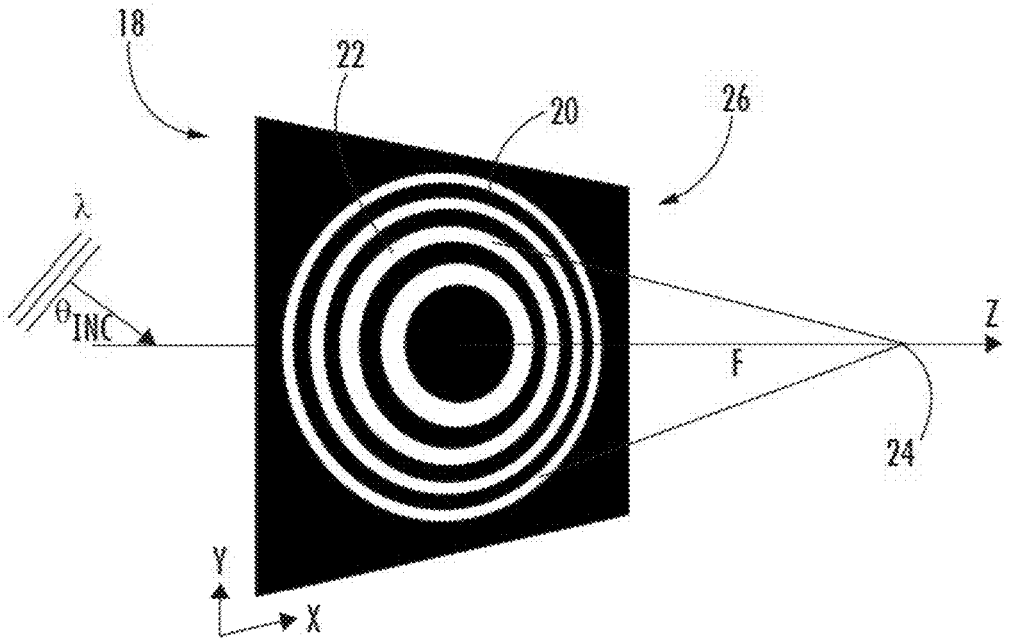
FIG. 2 depicts a Fresnel zone plate, according to an exemplary embodiment.

The mask pattern 18 is based on the diffraction pattern produced by a wave of electromagnetic radiation incident on a Fresnel zone plate (FZP) as shown in FIG. 2. In an FZP, the first sections 20 and the second sections 22 are a series of concentric rings that alternate between rings of the first section 20 and rings of the second section 22. The radii of the rings are based on the following equation:

$$r_n^2 = n\lambda\left(f + \frac{n\lambda}{4}\right)$$

In this equation, $r_n$ is the radius of the nth ring of the FZP, n is the integer number of rings, λ is the wavelength of the incident wave, and f is the focal length. The equation considers a wave that is incident at an incident angle $\theta_{inc}$ of 0°. When the incident angle $\theta_{inc}$ is 0° (i.e., the incident wave is substantially normal (e.g., within)+/−5° to the plane of the lens plate 16), the FZP will focus the waves through diffraction to a spot directly in line with an axis perpendicular to and passing through the center of the Fresnel zone at the focal length f away from the lens plate 16. Thus, in designing the antenna 10 of FIG. 1, the antenna array 14 would preferably be placed at the focal length f away from the lens plate 16 so that the maximum intensity of the wave is received by the antenna array 14. However, when the incident angle $\theta_{inc}$ does not equal 0°, the focal spot of the incident wave will not be directly in line with the axis perpendicular to the FZP. Instead, the focus of the obliquely incident wave will be off-center and diffuse as compared to the in-line and concentrated focal spot of an on-axis wave.

Figure 3A:
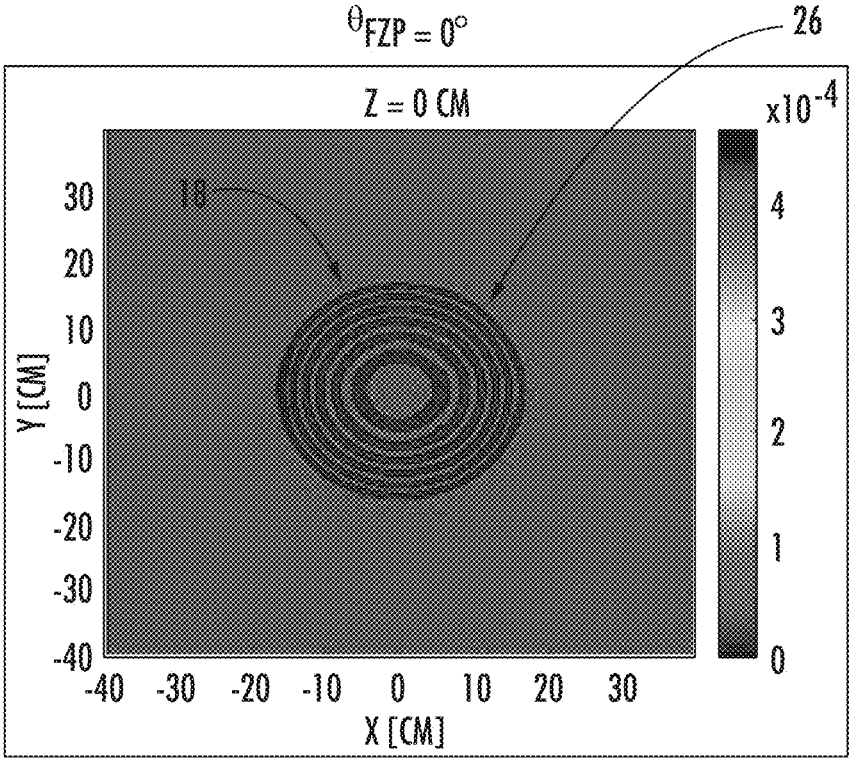
FIGS. 3A-3B depict a Fresnel zone plate and the corresponding diffracted wave pattern for a wave having a 0° incident angle, according to an exemplary embodiment.
Figure 3B:
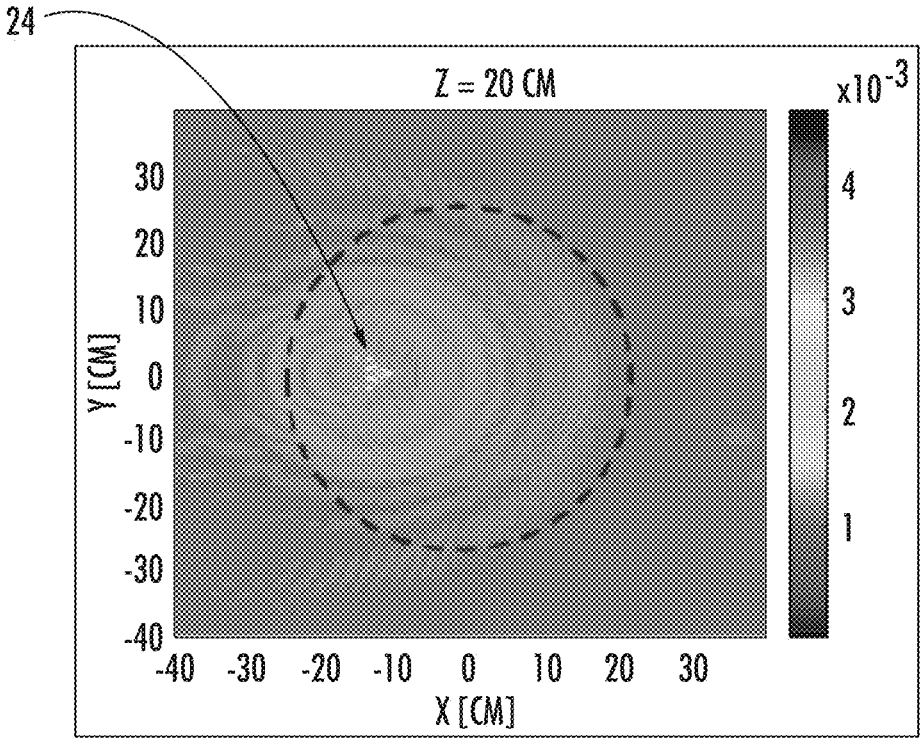

To illustrate, FIG. 3A depicts an FZP for a wave with an incident angle $\theta_{inc}$ of 0°, and FIG. 3B illustrates the distribution of intensity for a diffracted wave having an incident angle $\theta_{inc}$ of 30° off the perpendicular in the x-direction. As can be seen in FIG. 3B, the focal spot of the diffracted wave is displaced more than 10 cm away from the center. Thus, with respect to the embodiment shown in FIG. 1, the lens plate 16 would not diffract the incident wave to the desired region of the antenna array 14.

Figure 4A:
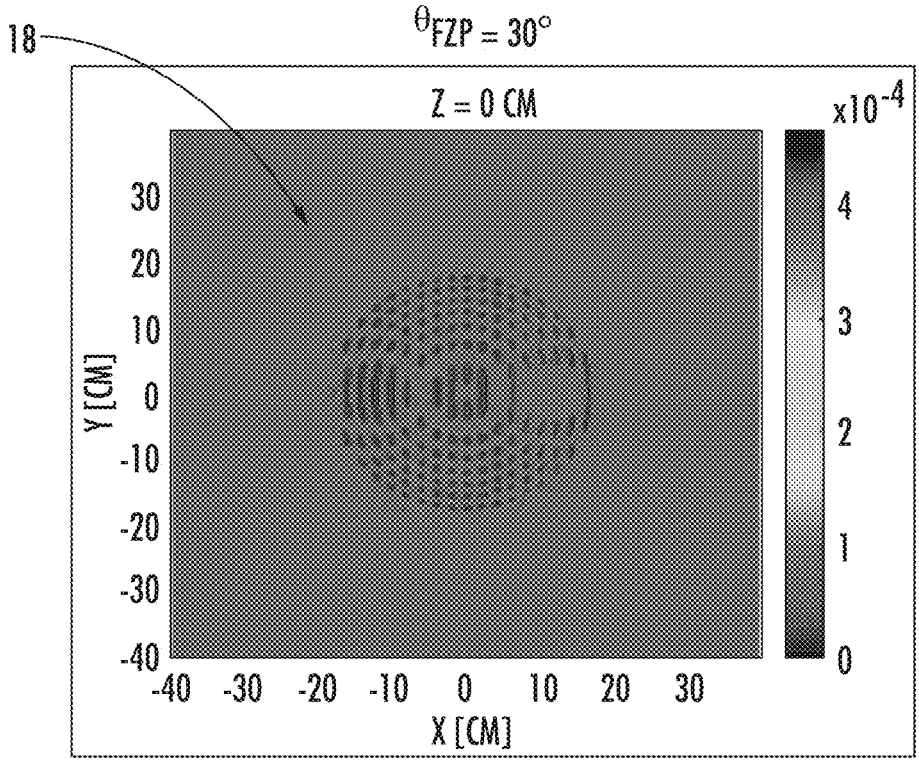
FIGS. 4A-4C depict a mask pattern for a lens plate configured to diffract waves of two different angles to the same focal spot, according to an exemplary embodiment.
Figure 4B:
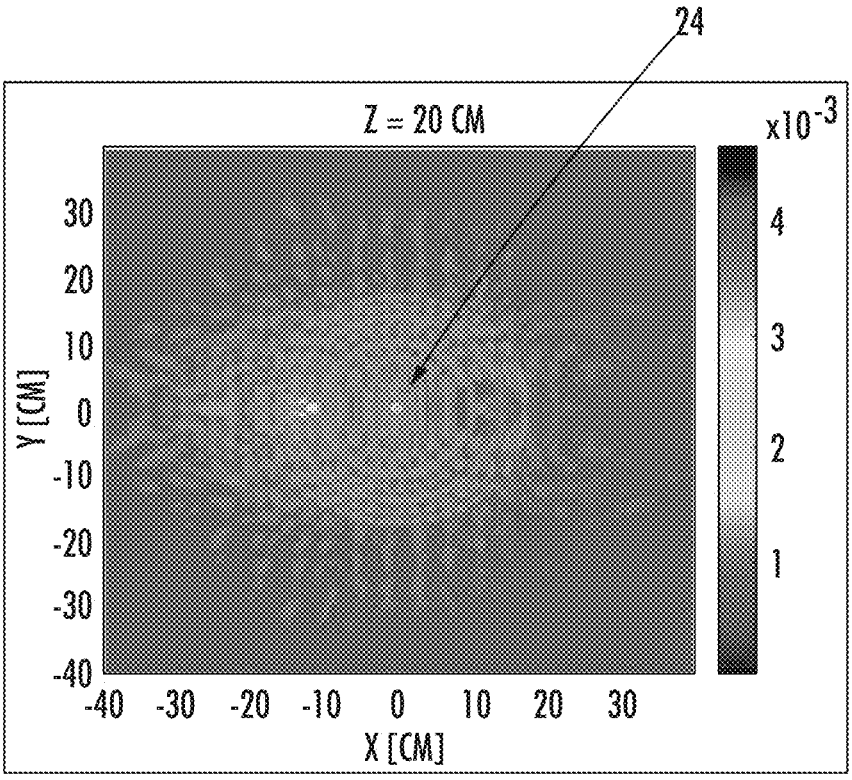
Figure 4C:
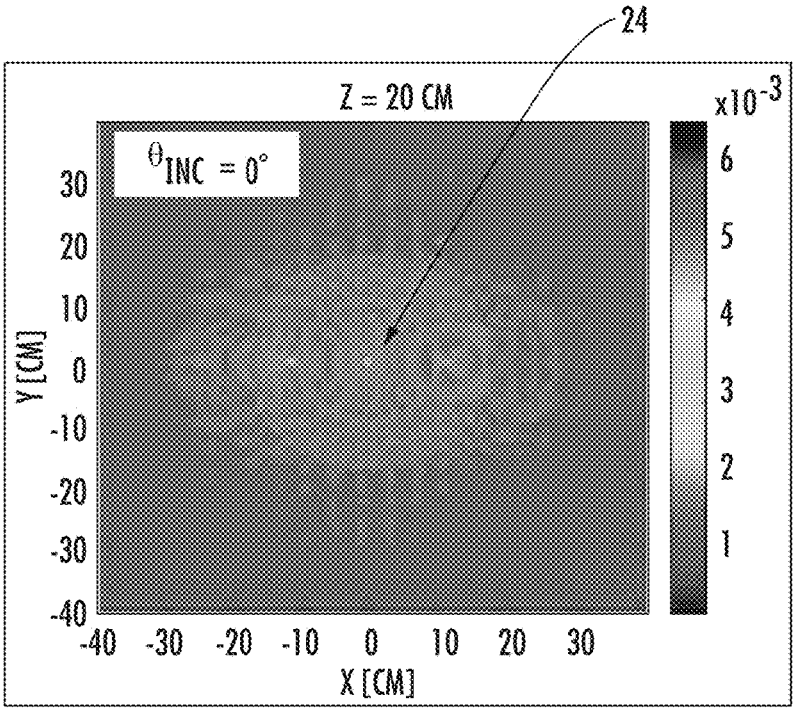

In order to re-center and concentrate the intensity of an incident wave that is off-axis, the mask pattern 18 is based off the intensity distribution pattern shown in FIG. 3B. That is, the mask pattern 18 shown in FIG. 4A is substantially the same as the intensity distribution shown in FIG. 3B. As shown in FIG. 4B, when a wave is incident upon the mask pattern 18 at an incident angle of 30°, the intensity distribution has a focal spot 24 centered at 0 in the x- and y-directions with respect to the graph shown in FIG. 4B. Additionally, when a wave is incident upon the mask pattern 18 at an incident angle of 0°, the diffracted intensity distribution also has a focal spot 24 centered at 0 in the x- and y-directions as shown in FIG. 4C. Thus, the mask pattern 18 of FIG. 4A provides a centered and concentrated intensity for waves that are incident at both 0° (FIG. 4C) and 30° (FIG. 4B). In practice, the mask pattern 18 provides a centered and concentrated intensity for waves incident at angles of 0°±5° and 30°±5°. That is, the mask pattern 18 can concentrate the intensity of a range of incident waves centered on the desired directions of incidence. In embodiments, the degree of separation between the directions of incidence is up to 45°. Accordingly, antennas 10 utilizing such a mask pattern 18 on the lens plate 16 are able to receive signals from multiple directions, or antennas 10 that are restricted in the installation geometry can still direct an off-axis signal to a desired region of an antenna array 14.

In other embodiments, the mask pattern 18 can be used to deliberately move the focal spot 24 off-center. For example, with reference to FIG. 1, the embodiment discussed in relation to FIGS. 4A-4C were designed to provide an on-center focal spot in the case of an incident wave that was off-axis. However, in the embodiments of FIGS. 5A-5D, the mask pattern 18 is configured to move the focal spot of an on-axis wave to an off-center position. For example, the wave may be incident on the lens plate 16 along a first axis, and the mask pattern 18 will produce a focal spot that is not on that first axis but on another axis spatially disposed from the first axis. In exemplary embodiments, the mask pattern 18 is configured to move the focal spot, e.g., to irradiate a desired portion of an antenna array 14 (as shown in FIG. 1) that is not located along the axis of incidence, or to accommodate off-axis placement of the array 14. In embodiments, the mask pattern 18 is configured to move the focal spot at least 5 cm off-center. In another embodiment, the mask pattern 18 is configured to move the focal spot at least 10 cm off-center, and in still another embodiment, the mask pattern 18 is configured to move the focal spot at least 20 cm off-center. In certain embodiments, the mask pattern is configured to move the focal spot up to 50 cm off center.

Figure 5A:
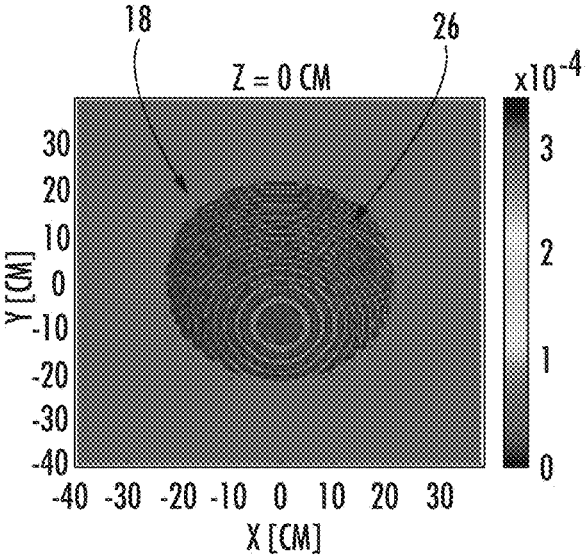
FIGS. 5A-5D depict mask patterns having offset Fresnel zone plates and their corresponding intensity distributions and focal points, according to an exemplary embodiment.
Figure 5B:
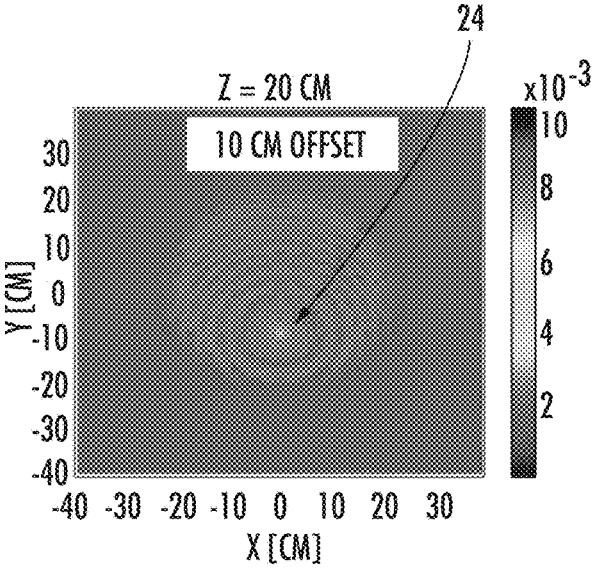
Figure 5C:
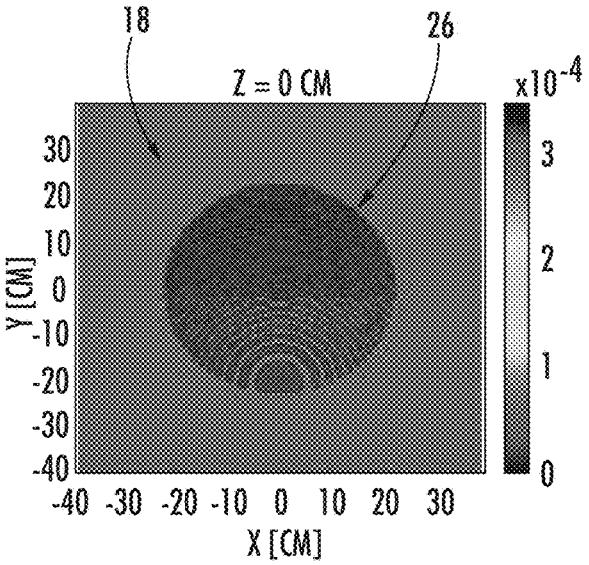
Figure 5D:
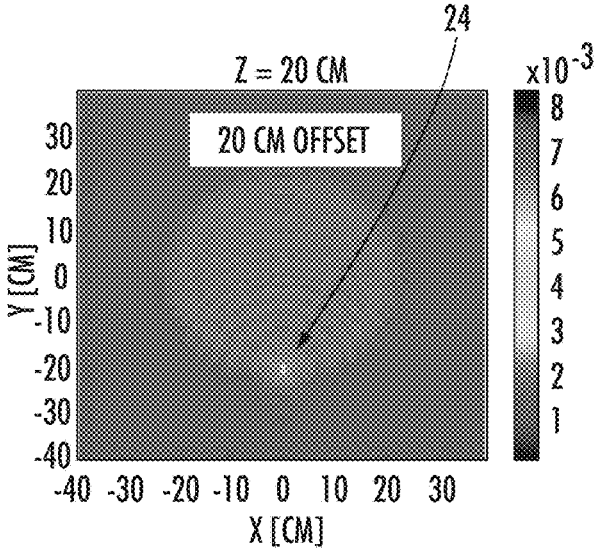

FIG. 5A depicts a mask pattern 18 designed to move the focal spot 10 cm down in the y-direction. The mask pattern 18 is based on an FZP 26 in which the center ring of the FZP 26 is off-set from the geometric center of the lens plate 16. FIG. 5B depicts the intensity distribution for a diffracted, on-axis wave (i.e., on an axis running through the geometric center of the mask pattern 18). As can be seen, the focal point 24 is at the same position (i.e., located along the same axis) as the center ring of the FZP 26. That is, with respect to the antenna unit 10 of FIG. 1, offsetting the center ring of the FZP 26 by 10 cm on the lens plate 16 causes the focal point 24 to be offset by 10 cm on the antenna array 14. FIG. 5C depicts an offset of the FZP 26 by 20 cm, and as can be seen in FIG. 5D, the focal point 24 is also offset by 20 cm.

The mask pattern 18 of FIGS. 5A and 5C may be useful, e.g., to accommodate deployment of the antenna unit 10 in situations where alignment of a phased antenna array with the lens plate 16 is not possible or is undesirable. Further, in embodiments, the antenna array 14 of the antenna 10 may not be centered within the housing 12. While the vertical position of the focal spot 24 was depicted as being moved in FIGS. 5A-5D, the horizontal position of the focal spot 24 could also be moved in embodiments by moving the center ring of the FZP 26 along the horizontal axis, and in other embodiments, the focal spot 24 can be moved both horizontally and vertically from the center of the mask pattern 18 by moving the center ring of the FZP 26 along both the horizontal and vertical axes.

Figure 6A:
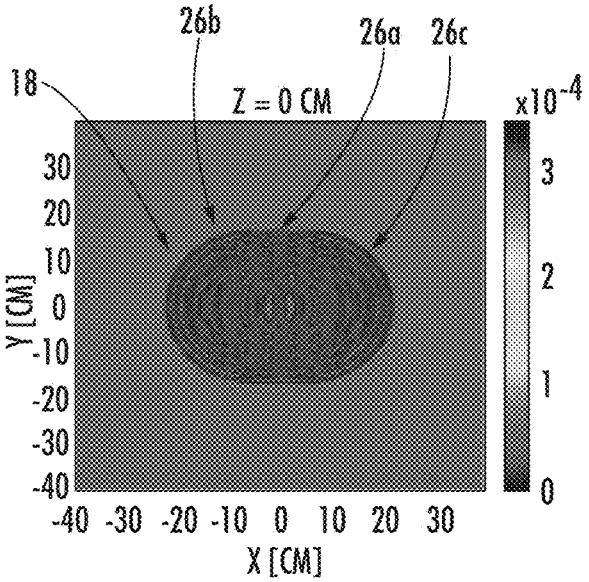
FIGS. 6A and 6B depict superimposed Fresnel zone plates to produce three focal points, according to an exemplary embodiment.
Figure 6B:
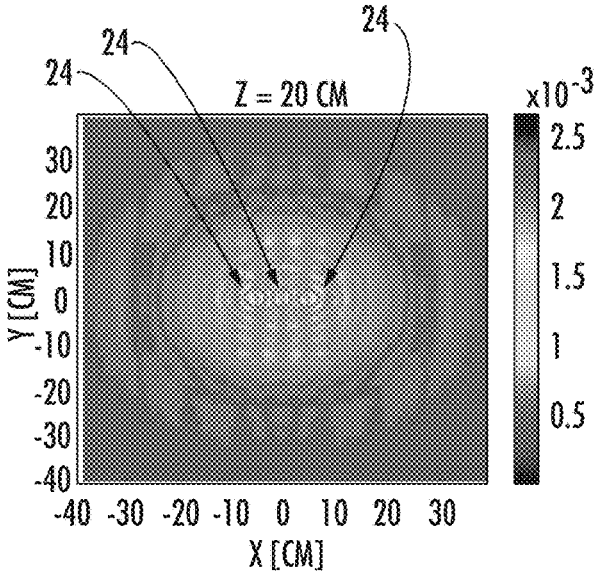

In still other embodiments, the mask pattern 18 is configured to provide multiple focal spots 24. FIG. 6A depicts an embodiment in which the mask pattern 18 comprises multiple superimposed FZP 26 across the x-direction. In general, each superimposed FZP 26 will produce its own focal spot 14. In particular, FIG. 6A includes three superimposed FZP 26: a central FZP 26*a*, a left FZP 26*b*, and a right FZP 26*c*. As shown in FIG. 6B, this pattern of FZP 26*a*, 26*b*, 26*c* produces three focal spots 24 in which each focal spot 24 is located at the center of each FZP 26*a*, 26*b*, 26*c* for an incident wave at an incident angle of 0°. Thus, the spacing of each focal spot 24 is determined by the spacing of the FZP 26*a*, 26*b*, 26*c*. The focal spots 24 are quasi-uniform in that the intensity is slightly greater and more concentrated in the focal spot 24 behind the center FZP 26*a* than the intensity of the focal spots 24 behind the outer FZP 26*b*, 26*c*. A multi-focal spot mask pattern may be used, e.g., to focus the wave on both a primary and a backup antenna array 14 such that the antenna unit 10 easily be switched back and forth between the primary and backup antenna array if one is damaged.

Figure 7A:
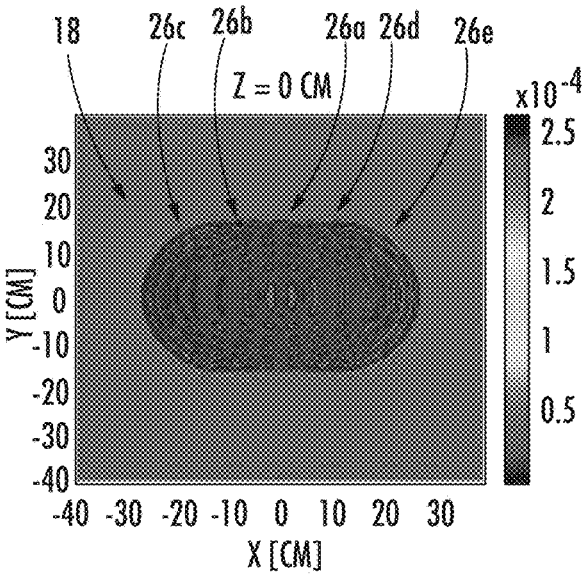
FIGS. 7A and 7B depict superimposed Fresnel zone plates to produce five focal points, according to an exemplary embodiment.
Figure 7B:
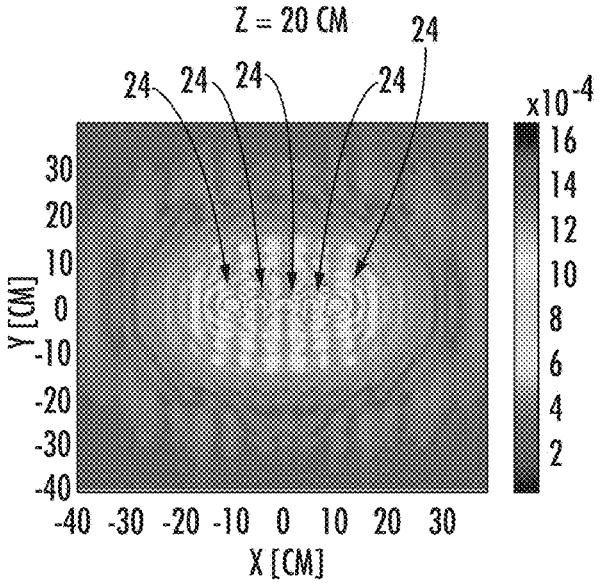

FIG. 7A depicts another embodiment in which the mask pattern 18 includes five superimposed FZP 26: a center FZP 26*a*, an intermediate left FZP 26*b*, a far left FZP 26*c*, an intermediate right FZP 26*d*, and a far right FZP 26*e*. As can be seen in the intensity distribution of FIG. 7B, the five, quasi-uniform focal spots 24 are produced behind the centers of each FZP 26*a*-26*e*. As with the previous embodiment shown in FIGS. 6A and 6B, the embodiment of FIGS. 7A and 7B demonstrate that the intensity and concentration of the focal spots 24 decreases moving outward from the center focal spot 24, which is located behind the center FZP 26*a*.

The embodiments of FIGS. 6A-6B and 7A-7B demonstrate that the focal spots 24 can be spaced along the horizontal axis of the antenna array 14. However, in other embodiments, the focal spots 24 could instead be spaced along the vertical axis of the antenna array 14 by superimposing the FZP 26 across the vertical axis instead. Further, the focal spots 24 of the embodiment depicted are all located along the same line as the other focal spots 24. However, by shifting one or more of the superimposed FZP 26 relative to the other FZP 26, the focal spots 24 can be arranged out of line from each other (see discussion of FIGS. 10A and 10B, below).

Figure 8A:
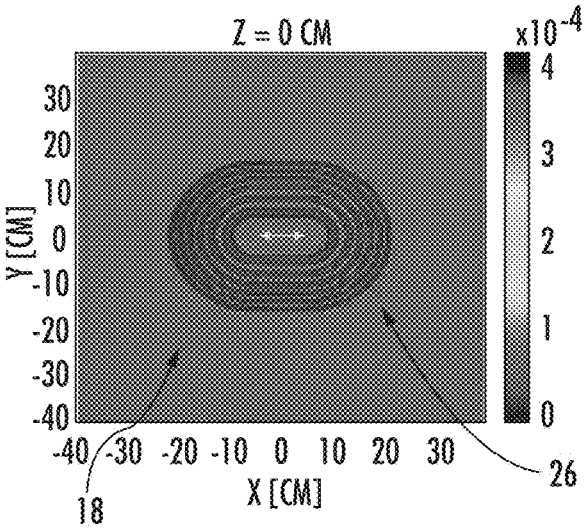
FIGS. 8A and 8B depict an obround Fresnel zone plate and corresponding focal points, according to an exemplary embodiment.
Figure 8B:
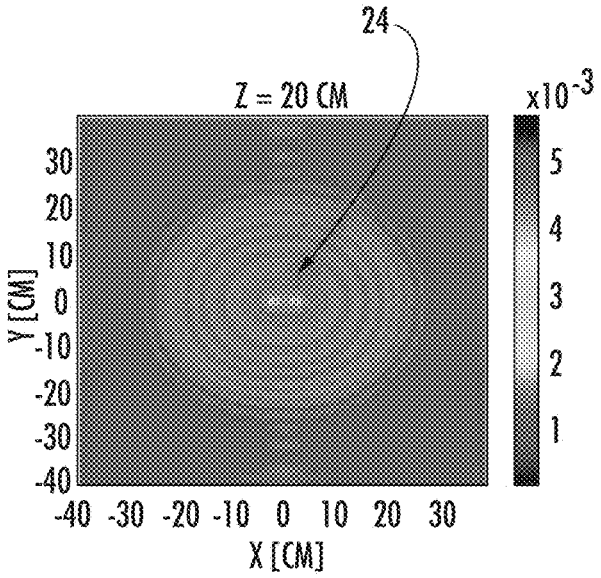

FIG. 8A demonstrates another configuration of an FZP 26 that provides two horizontally separated focal spots. The FZP 26 in this instance is obround, comprising two semicircles separated by a rectangular section. As shown in FIG. 8B, the focal points 24 are located at the ends of the rectangular section between the semicircle portions. In embodiments, the obround FZP 26 can be arranged along the vertical axis instead of the horizontal axis to provide focal points spaced apart on the horizontal axis. Further, in embodiments, the obround FZP 26 is arranged at an angle to both the horizontal and vertical axes to provide focal points 24 spaced apart diagonally.

Figure 9A:
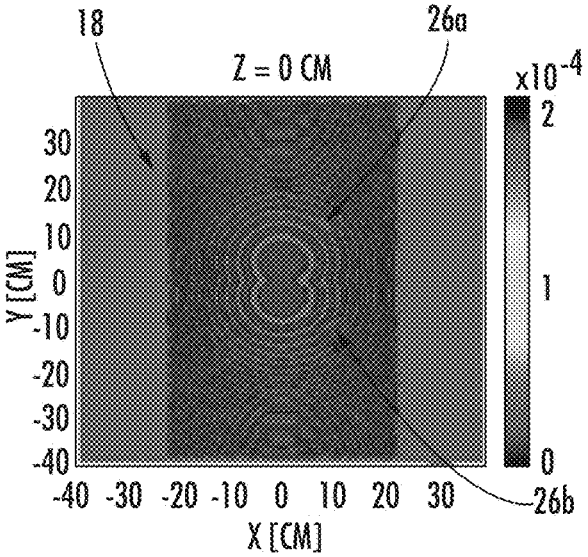
FIGS. 9A-9D depict overlapped and offset Fresnel zone plates and their corresponding focal points, according to an exemplary embodiment.
Figure 9B:
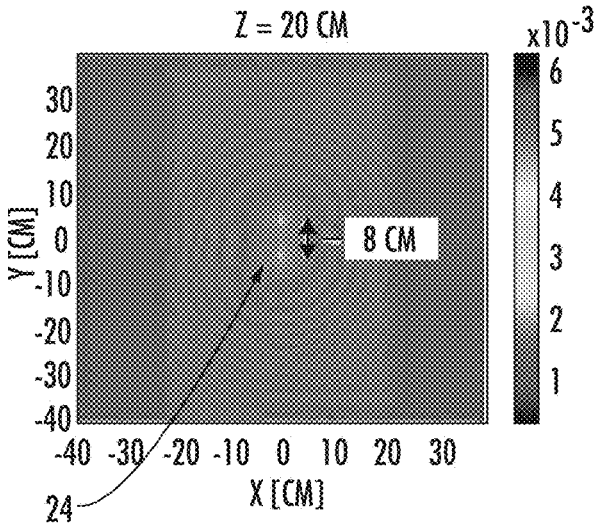
Figure 9C:
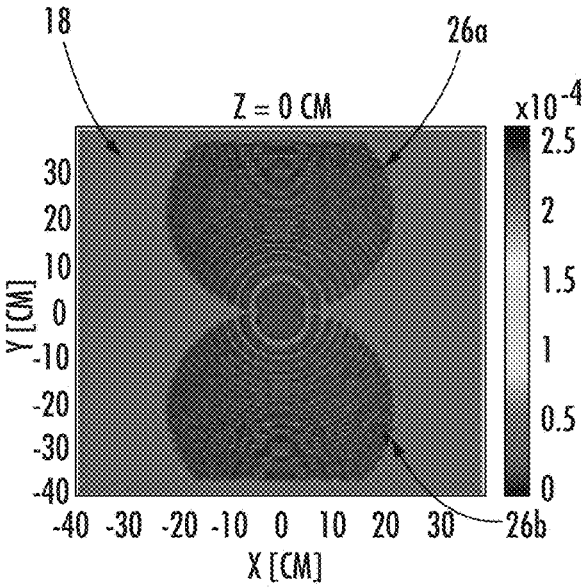
Figure 9D:
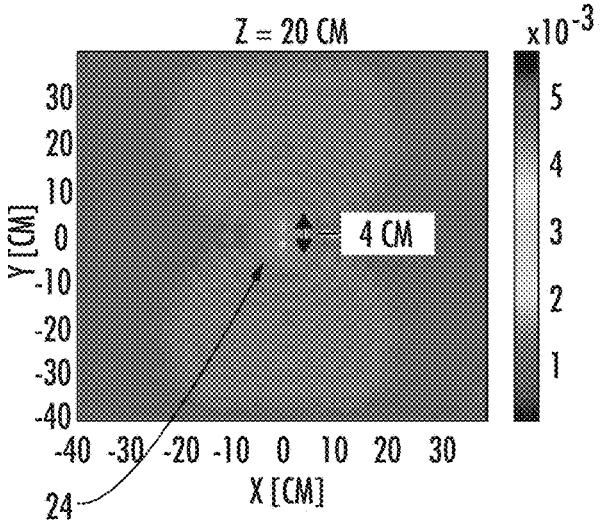

FIG. 9A depicts an embodiment in which a first offset FZP 26*a* is overlapped with a second offset FZP 26*b*. The FZP 26*a*, 26*b* are offset along the vertical axis such that the center ring of each FZP 26*a*, 26*b* is offset from the center of the lens plate 16. The center rings of the FZP 26*a*, 26*b* are also overlapped. As shown in FIG. 9B, the focal points 24 are located along the same axis as the center rings of the offset FZP 26*a*, 26*b*. FIG. 9C depicts another embodiment in which the center rings of FZP 26*a*, 26*b* are overlapped to a greater degree than in FIG. 9A. Thus, as shown in FIG. 9D, the focal points 24 are positioned closer together while still remaining offset. In embodiments, the overlapped and offset FZP 26*a*, 26*b* may be arranged along the horizontal axis instead of the vertical axis to provide focal points 24 spaced along the horizontal axis.

Figure 10A:
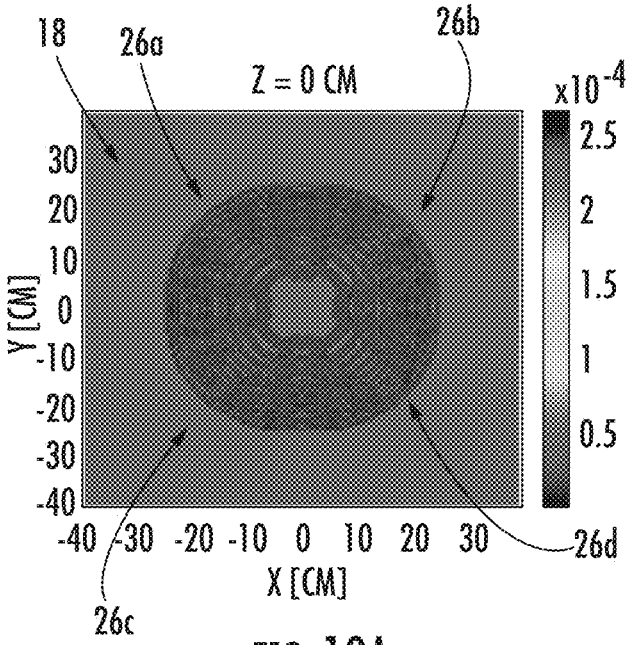
FIGS. 10A and 10B depict superimposed Fresnel zone plates that produce focal points arranged in a square, according to an exemplary embodiment.
Figure 10B:
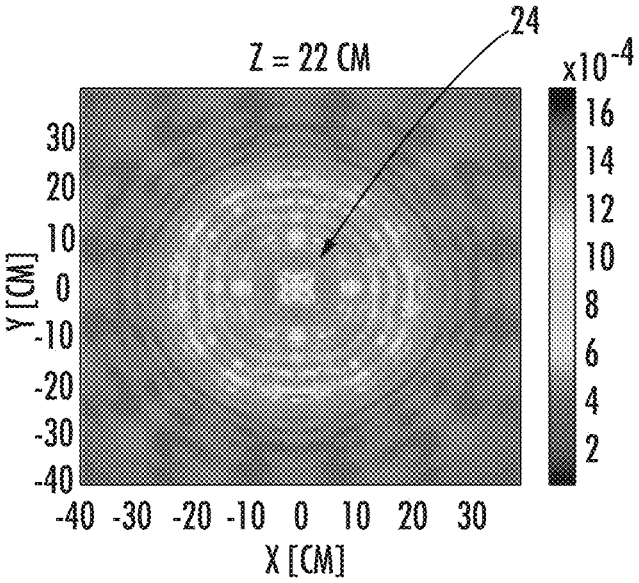

FIG. 10A depicts still another embodiment having multiple focal points 24 that are spaced apart. In particular, FIG. 10A includes four superimposed FZP 26*a*-26*d*. The FZP 26*a*-26*d* are arranged in a 2×2 array with overlapping quadrants. As shown in FIG. 10B, the focal points 24 are arranged in a square at the center of each FZP 26*a*-26*d*.

Having described various embodiments of the mask pattern 18, the following discussion will be directed to how to fabricate the mask pattern 18 on the lens plate 16. In embodiments, the mask pattern 18 is fabricated using screen printing or sputter coating. In an exemplary embodiment of screen printing, modelled data for the mask pattern 18 can be converted to screen-printable file using pattern design software. Thereafter, the screen mesh, emulsion thickness, and tension based on the pattern resolution are determined for the screen printing process. The material of the lens plate (e.g., glass having a thickness of 0.3-0.7 mm) is cleaned. For the screen printing ink, a microwave opaque material is selected for screen printing. The material can be absorbing or reflecting of microwaves. Examples include silver-based ink, silver nanowire-based ink. The screen area is flooded with the selected screen ink for the printing step, and when sufficient wetting of the screen surface is achieved, the print step is applied using varying print speed (mm/sec), gap (mm) and print pressure (KgF or psi). In embodiments, the thickness of the opaque material deposited onto the lens plate is about 10 to 15 μm thick. Once the ink is applied, it is baked or UV-cured. Alternatively, low E coating (such as those used for window applications) can be vacuum deposited on a pre-masked glass substrate and followed by the removal of the mask after deposition. Resistitivity values of 0.03-10 Ω/m indicate that the layer will be opaque to microwave in the frequency of interest.

Unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is in no way intended that any particular order be inferred. In addition, as used herein, the article "a" is intended to include one or more than one component or element, and is not intended to be construed as meaning only one.

It will be apparent to those skilled in the art that various modifications and variations can be made without departing from the spirit or scope of the disclosed embodiments. Since modifications, combinations, sub-combinations and variations of the disclosed embodiments incorporating the spirit and substance of the embodiments may occur to persons skilled in the art, the disclosed embodiments should be construed to include everything within the scope of the appended claims and their equivalents.

What is claimed is:

1. An antenna unit, comprising:

an antenna array comprising a plurality of antennas, the antenna array defining a first plane; and a lens plate comprising a mask pattern, the lens plate defining a second plane, wherein and the lens plate is spaced apart from the antenna array and wherein the second plane of the lens plate is substantially parallel to the first plane of the antenna array;

wherein the mask pattern is configured to focus first waves incident on the lens plate through diffraction to a first region of the antenna array, the first waves being incident on the lens plate at a first angle relative to an axis normal to the second plane of the lens plate; and wherein the mask pattern is configured to focus second waves incident on the lens plate through diffraction to the first region of the antenna array, the second waves being incident on the lens plate at a second angle relative to the axis, the second angle being different from the first angle, and wherein the mask pattern is defined by an interference pattern produced by the superposition of two mask patterns.

2. The antenna unit of claim 1, wherein the mask pattern is based on a Fresnel zone plate.

3. The antenna unit of claim 2, wherein the mask pattern is defined by an interference pattern corresponding to waves with two different incident angles, wherein the first angle is 0°.

4. The antenna unit of claim 1, wherein the mask pattern comprises sections opaque to the first waves and to the second waves and sections transparent to the first waves and to the second waves.

5. The antenna unit of claim 1, wherein the mask pattern comprises a difference in thickness between first sections and second sections that result in a path length difference equivalent to a wavelength of the first waves or second waves divided by two.

6. The antenna unit of claim 1, wherein the first waves and the second waves each have a frequency in a range of 20 GHz to 100 GHz.

7. The antenna unit of claim 1, wherein a difference between the first angle and the second angle is up to 45°.

8. The antenna unit according claim 1 wherein the antenna array comprises at least three antennas.

9. An antenna unit, comprising:

an antenna array comprising a plurality of antennas, the antenna array defining a first plane; and a lens plate comprising a mask pattern, the lens plate defining a second plane, wherein the lens plate is spaced apart from the antenna array;

wherein the mask pattern comprises a Fresnel zone plate having a center ring centered on a first axis that is normal to the second plane of the lens plate, and is the product of the superposition of two patterns; and wherein the mask pattern is configured to focus waves incident on the lens plate along a second axis that is normal to second plane of the lens plate to a region of the antenna array that is located on the first axis, the first axis being spaced apart from the second axis.

10. The antenna unit of claim 9, wherein the Fresnel zone plate comprises alternating rings opaque to the waves incident on the lens plate and rings transparent to the waves incident on the lens plate.

11. The antenna unit of claim 9, wherein the mask pattern comprises a difference in thickness between first sections and second sections that result in a path length difference equivalent to a wavelength of the waves incident on the lens plate divided by two.

12. The antenna unit of claim 9, wherein the waves incident on the lens plate have a frequency in a range of 20 GHz to 100 GHz.

13. The antenna unit of claim 9, wherein the first axis and the second axis are spaced apart by at least 5 cm.

14. The antenna unit of claim 9, wherein the first axis and the second axis are spaced apart by up to 50 cm.

15. An antenna unit, comprising:

an antenna array comprising a plurality of antennas, the antenna array defining a first plane; and a lens plate comprising a mask pattern, the lens plate defining a second plane, wherein the lens plate is spaced apart from the antenna array and wherein the second plane of the lens plate is substantially parallel to the first plane of the antenna array;

wherein the mask pattern is configured to focus waves incident on the lens plate to at least two different focal points within the antenna array, and wherein the mask pattern comprises an obround Fresnel zone plate.

16. The antenna unit of claim 15, wherein the mask pattern comprises two Fresnel zone plates in which a center ring of a first Fresnel zone plate overlaps with a center ring of a second Fresnel zone plate.

17. An antenna unit, comprising:

an antenna array comprising a plurality of antennas, the antenna array defining a first plane; and a lens plate comprising a mask pattern the lens plate defining a second plane, wherein the lens plate is spaced apart from the antenna array and wherein the second plane of the lens plate is substantially parallel to the first plane of the antenna array;

wherein the mask pattern is configured to focus waves incident on the lens plate to at least two different focal points within the antenna array, wherein the mask pattern comprises at least two of superimposed Fresnel zone plates that at least partially overlap and wherein the at least two focal points comprises a focal point for each of the plurality of superimposed Fresnel zone plates.

18. The antenna unit of claim 17, wherein the plurality of superimposed Fresnel zone plates comprises at least three Fresnel zone plates that overlap along at least one of a horizontal axis or a vertical axis of the lens plate, the at least three Fresnel zone plates producing at least three focal points.

19. The antenna unit of claim 18, wherein each of the at least three focal points lie along a line.

20. The antenna unit of claim 17, wherein the plurality of superimposed Fresnel zone plates comprises four Fresnel zone plates that overlap in such a way to produce four focal points that form a square.

* * * * *